US009035835B2

(12) United States Patent
Jenwatanavet

(10) Patent No.: US 9,035,835 B2
(45) Date of Patent: May 19, 2015

(54) ANTENNA APPARATUS FOR A WIRELESS DEVICE

(71) Applicant: QUALCOMM Incorporated, San Diego, CA (US)

(72) Inventor: Jatupum Jenwatanavet, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 276 days.

(21) Appl. No.: 13/773,633

(22) Filed: Feb. 22, 2013

(65) Prior Publication Data

US 2014/0240182 A1 Aug. 28, 2014

(51) Int. Cl.
*H01Q 1/12* (2006.01)
*H01Q 1/27* (2006.01)
*H01Q 7/00* (2006.01)

(52) U.S. Cl.
CPC . *H01Q 1/273* (2013.01); *H01Q 7/00* (2013.01)

(58) Field of Classification Search
CPC ..... H01Q 1/273; H01Q 7/00
USPC ..... 343/702, 718, 850, 852, 860
See application file for complete search history.

(56) References Cited

U.S. PATENT DOCUMENTS

| | | | | |
|---|---|---|---|---|
| 6,278,873 | B1 | 8/2001 | Itakura et al. | |
| 7,126,540 | B2 * | 10/2006 | Hsu et al. | 343/700 MS |
| 7,307,592 | B2 * | 12/2007 | Park et al. | 343/702 |
| 7,379,712 | B2 | 5/2008 | Saarnimo | |
| 7,592,964 | B2 * | 9/2009 | Mullenborn et al. | 343/788 |
| 7,612,725 | B2 | 11/2009 | Hill et al. | |
| 7,652,628 | B2 * | 1/2010 | Zweers | 343/702 |
| 7,667,657 | B2 | 2/2010 | Koshiji | |
| 8,237,623 | B2 * | 8/2012 | Hung | 343/906 |
| 2007/0229376 | A1 * | 10/2007 | Desclos et al. | 343/718 |
| 2007/0241974 | A1 * | 10/2007 | Kanagawa et al. | 343/718 |
| 2012/0009983 | A1 | 1/2012 | Mow et al. | |

* cited by examiner

*Primary Examiner* — Tho G Phan
(74) *Attorney, Agent, or Firm* — Smith Risley Tempel Santos LLC

(57) ABSTRACT

An antenna apparatus for a wireless device includes a continuous metallic component electrically connected to a circuit card assembly through an interconnection, an antenna matching circuit electrically connected to the continuous metallic component, a first electrical connection between the continuous metallic component and the interconnection, and at least one additional electrical connection between the interconnection and the circuit card assembly, the antenna matching circuit and the interconnection causing the continuous metallic component to resonate at an at least one desired frequency.

36 Claims, 11 Drawing Sheets

700

800

| Freq. (MHz) | Gain Total, dB | Gain Phi, dB | Gain Theta, dB | Efficiency (dB) |
|---|---|---|---|---|
| 2400 | 3.8 | 3.8 | 3.8 | -1.7 |
| 2405 | 4.2 | 4.1 | 4.1 | -1.3 |
| 2410 | 4.1 | 4.1 | 4.1 | -1.7 |
| 2415 | 4.3 | 4.3 | 4.3 | -1.4 |
| 2420 | 4.2 | 4.1 | 4.1 | -1.5 |
| 2425 | 4.0 | 4.0 | 4.0 | -1.6 |
| 2430 | 4.0 | 4.0 | 4.0 | -1.3 |
| 2435 | 3.7 | 3.5 | 3.5 | -1.6 |
| 2440 | 4.1 | 3.4 | 3.9 | -1.3 |
| 2445 | 3.8 | 2.8 | 3.7 | -1.6 |
| 2450 | 4.1 | 3.2 | 3.8 | -1.5 |
| 2455 | 4.0 | 2.9 | 4.0 | -1.6 |
| 2460 | 3.9 | 2.7 | 3.8 | -1.7 |
| 2465 | 4.2 | 3.0 | 4.1 | -1.6 |
| 2470 | 4.1 | 2.5 | 4.1 | -1.7 |
| 2475 | 3.9 | 2.6 | 3.9 | -1.8 |
| 2480 | 4.4 | 2.5 | 4.3 | -1.6 |
| 2485 | 4.0 | 2.3 | 4.0 | -1.9 |
| 2490 | 4.3 | 2.6 | 4.2 | -1.7 |
| 2495 | 4.3 | 2.4 | 4.3 | -1.6 |
| 2500 | 4.0 | 2.6 | 4.0 | -1.8 |

FIG. 8

ANTENNA APPARATUS FOR A WIRELESS DEVICE

BACKGROUND

Electronic devices are becoming more and more portable. One portable form factor of particular interest is referred to as a "wrist-worn" device. Many different types of devices can be incorporated into a wrist-worn device form factor including, for example, a display device, a communication device and other devices. If the device is a communication device, it generally includes an antenna system for transmitting and/or receiving a communication signal.

In a small wrist-worn communication device, antenna design is very challenging due to factors such as device size, the material or materials from which the device is fabricated, orientation of the device during use, proximity of the device to an individual wearing the device, and other factors. These factors are also applicable to devices other than wrist-worn devices, such as tablet and other hand-held computing and electronic devices.

One factor of particular interest is that a metallic structure included in many of the above mentioned devices inhibits the ability of the antenna to properly radiate and receive electromagnetic energy. Such a metallic structure could be a bezel, a bracelet, a cuff, a band or another metallic structure. The extent of degradation in performance is directly related to the proximity of the antenna to the metallic structure. A metal ring or loop shaped structure in a wrist-worn or other device can significantly degrade the performance of an antenna located inside of the device. As a result there is a tradeoff between antenna design and industrial/mechanical design because antenna design dictates the absence of any metallic ring or loop shaped component in the device, but such a ring or loop shaped component may be desired in such a device for aesthetic purposes.

It is possible to use such a metallic structure as an antenna if the ring or loop shaped structure is non-continuous so that the length of the antenna can be controlled so as to correspond to a wavelength of a communication signal at a desired frequency. Unfortunately, there are many instances where it is not possible to separate the ring or loop structure into a non-continuous element.

Therefore, it would be desirable to have a way of using a continuous metallic ring or loop shaped component in a wrist-worn or other portable device as an antenna.

SUMMARY

In an embodiment, an antenna apparatus for a wireless device comprises a continuous metallic component electrically connected to a circuit card assembly through an interconnection, an antenna matching circuit electrically connected to the continuous metallic component, a first electrical connection between the continuous metallic component and the interconnection, and at least one additional electrical connection between the interconnection and the circuit card assembly, the antenna matching circuit and the interconnection causing the continuous metallic component to resonate at an at least one desired frequency.

BRIEF DESCRIPTION OF THE DRAWINGS

In the figures, like reference numerals refer to like parts throughout the various views unless otherwise indicated. For reference numerals with letter character designations such as "102*a*" or "102*b*", the letter character designations may differentiate two like parts or elements present in the same figure. Letter character designations for reference numerals may be omitted when it is intended that a reference numeral encompass all parts having the same reference numeral in all figures.

FIG. 8 is a graphical diagram illustrating dual polarization performance of an embodiment of an antenna apparatus for a wireless device.

DETAILED DESCRIPTION

Figure 1:
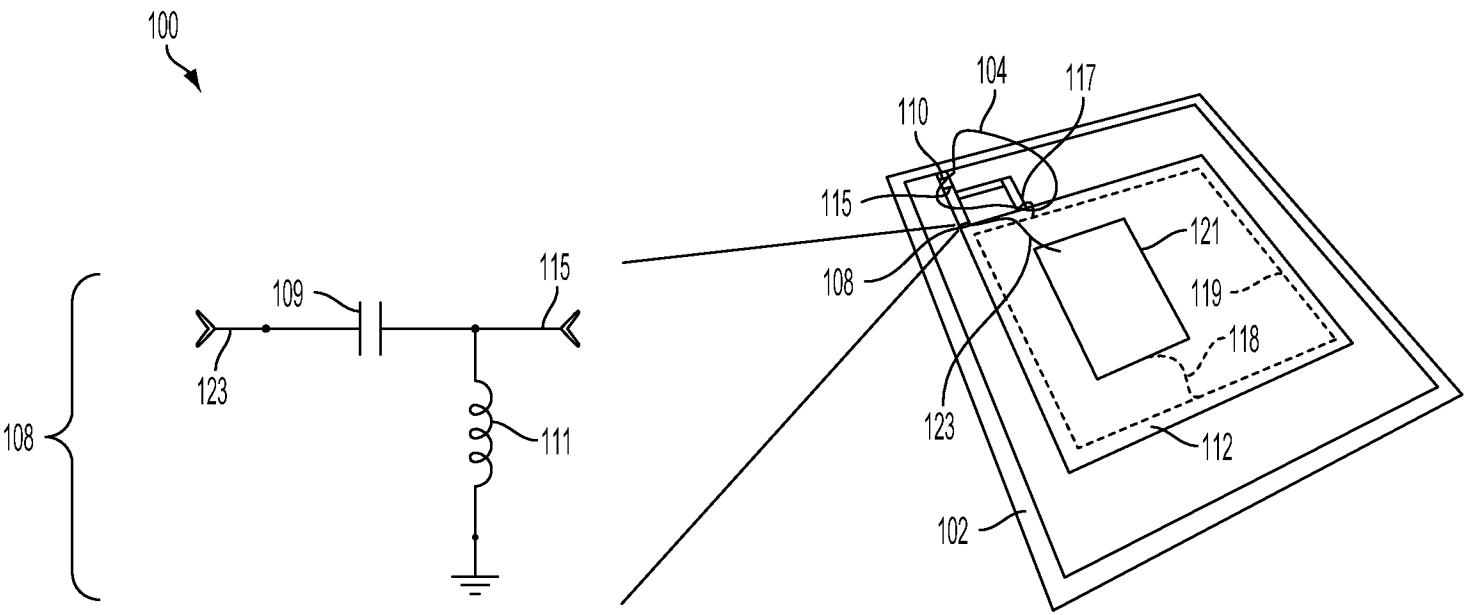
FIG. 1 is a diagram illustrating an embodiment of an antenna apparatus for a wireless device.

The word "exemplary" is used herein to mean "serving as an example, instance, or illustration." Any aspect described herein as "exemplary" is not necessarily to be construed as preferred or advantageous over other aspects.

In this description, the term "application" may also include files having executable content, such as: object code, scripts, byte code, markup language files, and patches. In addition, an "application" referred to herein, may also include files that are not executable in nature, such as documents that may need to be opened or other data files that need to be accessed.

The term "content" may also include files having executable content, such as: object code, scripts, byte code, markup language files, and patches. In addition, "content" referred to herein, may also include files that are not executable in nature, such as documents that may need to be opened or other data files that need to be accessed.

As used in this description, the terms "component," "database," "module," "system," and the like are intended to refer to a computer-related entity, either hardware, firmware, a combination of hardware and software, software, or software in execution. For example, a component may be, but is not limited to being, a process running on a processor, a processor, an object, an executable, a thread of execution, a program, and/or a computer. By way of illustration, both an application running on a computing device and the computing device may be a component. One or more components may reside within a process and/or thread of execution, and a component may be localized on one computer and/or distributed between two or more computers. In addition, these components may execute from various computer readable media having various data structures stored thereon. The components may communicate by way of local and/or remote processes such as in accordance with a signal having one or more data packets (e.g., data from one component interacting with another component in a local system, distributed system, and/or across a network such as the Internet with other systems by way of the signal).

As used herein, the terms "transducer" and "transducer element" refer to an antenna element that can be stimulated with a feed current to radiate electromagnetic energy, and an antenna element that can receive electromagnetic energy and convert the received electromagnetic energy to a receive current that is applied to receive circuitry.

As used herein, the term "orthogonal" refers to lines, line segments, or electric fields that are perpendicular at their point of intersection.

As used here, the term "orthogonal electric fields" refers to the orientation of two electric fields that are perpendicular to each other.

As used herein, the term "dual polarization" refers to an antenna that generates two electric fields and that has two components that are orthogonal to each other.

The antenna apparatus for a wireless device can be incorporated into or used with a communication device, such as, but not limited to, a cellular telephone, a computing device, such as a smart phone, a tablet computer, or any other communication device.

FIG. 1 is a diagram illustrating an embodiment of an antenna apparatus for a wireless device. The antenna apparatus for a wireless device uses an existing continuous metallic ring shaped or loop shaped component or structure, such as a bezel, a bracelet, a cuff, a band, or another structure that is part of the wireless device, as a transducer without altering the continuity of the continuous metallic ring shaped or loop shaped component. The continuous metallic ring shaped or loop shaped component is electrically unbroken and has no gaps or breaks.

In an embodiment, the antenna apparatus 100 comprises a continuous metallic ring shaped or loop shaped component 102, also referred to as a continuous metallic component 102 for simplicity, an interconnection element 104 for connecting the continuous metallic component 102 to a circuit card assembly 112, and an antenna matching circuit 108. In an embodiment, the interconnection element 104 can comprise a feed connection 115, a connection 123 to a radio frequency (RF) circuit 121, and a ground connection 117. The circuit card assembly 112 can comprise the radio frequency (RF) circuit 121, a ground plane 119, a connection 118 between the RF circuit 121 and the ground plane 119, and other components that are not shown for simplicity. The ground plane 119 is shown as a rectangular element for simplicity, but can be any shape and can occupy some or all of the area of the circuit card assembly 112. If the circuit card assembly 112 is a multi-layer structure, the ground plane 119 can occupy one or more of the layers.

The antenna apparatus 100 uses a single connection 110 to electrically connect the continuous metallic component 102 to the circuit card assembly (CCA) 112 via the interconnection element 104, thus simplifying the connection and enabling a mechanically simple design that provides a robust electrical connection.

The antenna matching circuit 108 can be located on the circuit card assembly 112 or can be located on the interconnection element 104. The antenna matching circuit 108, the interconnection element 104, and the electrical connections associated with the interconnection element 104 and the antenna matching circuit 108 electrically alter an impedance of the continuous metallic component 102 so that the continuous metallic component 102 resonates at a desired frequency. The desired frequency can be a single frequency, or can be more than one frequency in a multiple frequency band operating system. In an embodiment, the desired frequency can be in the range of 2.4 to 2.5 gigahertz (GHz), the so-called "Bluetooth" communication band. The antenna matching circuit 108 may comprise resistive elements, capacitive elements, inductive elements, or a combination of one or more of these elements. In an embodiment, the antenna matching circuit 108 comprises a capacitive element 109 and an inductive element 111. In an embodiment, the capacitive element 109 may comprise a capacitor having a nominal value of 0.8 picofarads (pF) and the inductive element 111 may comprise an inductor having a nominal value of 10 nanohenrys (nH). However, these values are examples for a particular desired operating frequency and are subject to system design considerations.

The interconnection element 104 and the antenna matching circuit 108 allow the continuous metallic component 102 to resonate and function as a transducer element at the desired frequency or frequencies using the single feed connection 110 to connect the interconnection element 104 to the continuous metallic component 102. In addition, the interconnection element 104 and the antenna matching circuit 108 allow the continuous metallic component 102 to resonate at the desired frequency or frequencies even though the total circumferential length of the continuous metallic component 102 can be random and independent of the desired wavelength or wavelengths of the communication signal at the desired frequency or frequencies. In particular, the total circumferential length of the continuous metallic component 102 need not necessarily correspond to a particular whole, multiple or fraction of the wavelength of the communication signal at the desired resonant frequency or resonant frequencies. In this manner, a continuous metallic component 102 can have an arbitrary length and need not be designed to have a length that is a whole, a multiple, or any fraction of the wavelength at the desired resonant frequency or resonant frequencies, but can still function as a transducer at the desired resonant frequency or resonant frequencies.

The continuous metallic component 102 need not be a circular or rectangular shape, but instead, can be any shape, so long as the continuous metallic component 102 forms a continuous loop of electrically conductive metallic material.

The interconnection element 104 forms an electrical bridge between the continuous metallic component 102 and the circuit card assembly 112. In an embodiment, the interconnection element 104 provides three points of contact between the continuous metallic component 102 and the circuit card assembly 112. The first point of contact being the single feed connection 110 to connect the circuit card assembly 112 to the continuous metallic component 102 via the interconnection element 104, the second point of contact being an electrical connection 123 between the RF circuit 121 on the circuit card assembly 112 and the interconnection element 104 via the antenna matching circuit 108, and the third point of contact being the ground connection 117 to the ground plane 119.

In an embodiment, the continuous metallic component 102 is located in a plane that is different than the plane in which the circuit card assembly 112 is located; however, this arrangement is not necessary and the continuous metallic component 102 may indeed be located in a plane that is the same as the plane in which the circuit card assembly 112 is located.

Figure 2B:
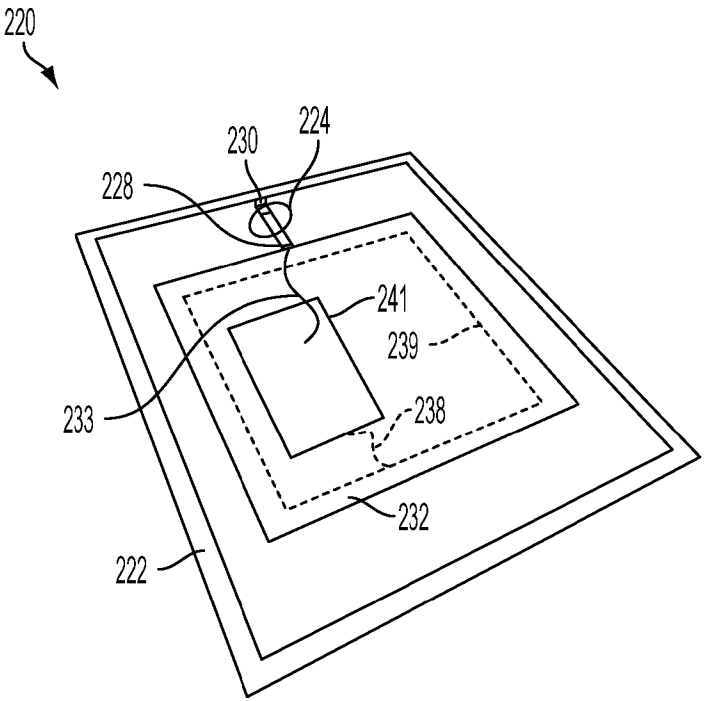
FIGS. 2A and 2B are diagrams illustrating embodiments of an antenna apparatus for a wireless device.
Figure 2A:
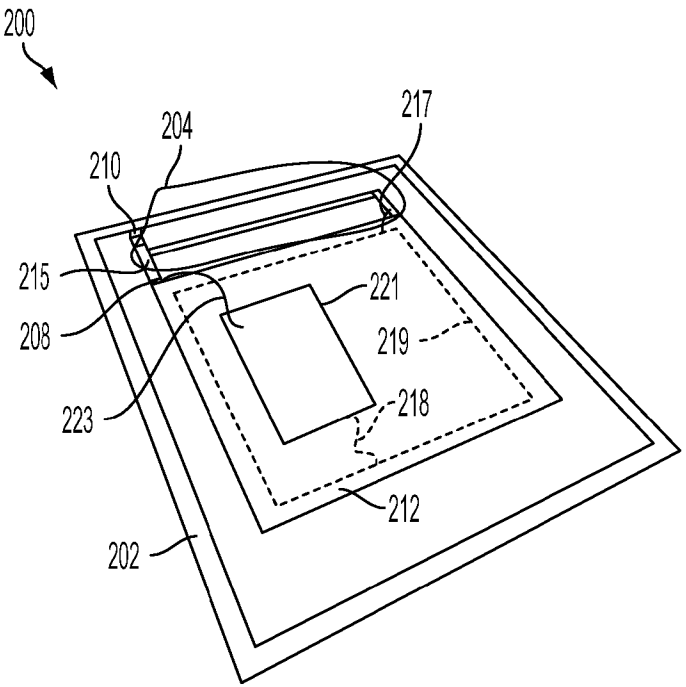

FIGS. 2A and 2B are diagrams illustrating embodiments of an antenna apparatus for a wireless device. Elements in FIGS. 2A and 2B that are similar to elements in FIG. 1 are labeled using the nomenclature 2XX, where "2XX" in FIGS. 2A and 2B denotes a similar element "1XX" in FIG. 1. In FIG. 2A, the antenna apparatus 200 uses a metallic bezel 202 of a device such as a tablet computing device or the like as an active portion of a transducer. The metallic bezel 202 comprises an embodiment of the continuous metallic component 102 described above. In this embodiment, the metallic bezel 202 is located in a plane that is above the plane in which the circuit card assembly 212 is located. However, the metallic bezel 202 can be located in a plane that is the same plane in which the circuit card assembly 212 is located. The interconnection element 204 and antenna matching circuit 208 are shown for reference. The interconnection element 204 can comprise a feed connection 215 and a ground connection 217. In the embodiment shown in FIG. 2A, a single connection 210 electrically connects the metallic bezel 202 to the circuit card assembly 212 via the interconnection element 204. The circuit card assembly 212 also comprises an RF circuit 221 and a ground plane 219 connected by a conductor 218.

In the embodiment shown in FIG. 2A, the interconnection element 204 has three points of contact, the first point of contact being the single feed connection 210 to connect the circuit card assembly 212 to the metallic bezel 202 via the interconnection element 204, the second point of contact being the connection 223 between the RF circuit 221 on the circuit card assembly 212 and the interconnection element 204 via the antenna matching circuit 208, and the third point of contact being the ground connection 217 to the ground plane 219.

In FIG. 2B, the antenna apparatus 220 uses a metallic bezel 222 of a device such as a tablet computing device or the like as an antenna. The metallic bezel 222 comprises an embodiment of the continuous metallic component 102 described above. In this embodiment, the metallic bezel 222 is located in a plane that is above the plane in which the circuit card assembly 232 is located. However, the metallic bezel 222 can be located in a plane that is the same plane in which the circuit card assembly 232 is located. The interconnection element 224 and antenna matching circuit 228 are shown for reference. In this embodiment, the interconnection element 224 can comprise only a feed connection embodied by a single connection 230 that electrically connects the metallic bezel 222 to the circuit card assembly 232 via the interconnection element 224. The circuit card assembly 232 also comprises an RF circuit 241 and a ground plane 239 connected by a conductor 238.

In the embodiment shown in FIG. 2B, the interconnection element 224 has only two points of contact, the first point of contact being the single connection 230 to the metallic bezel 222, the second point of contact being the connection 233 to connect the RF circuit 241 on the circuit card assembly 232 to the interconnection element 224 via the antenna matching circuit 228.

Figure 3B:
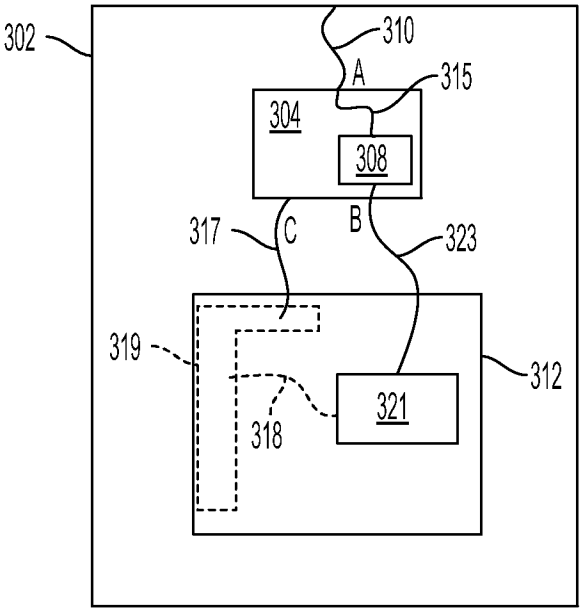
FIGS. 3A and 3B are diagrams illustrating embodiments of the antenna apparatus for a wireless device of FIG. 2A.
Figure 3A:
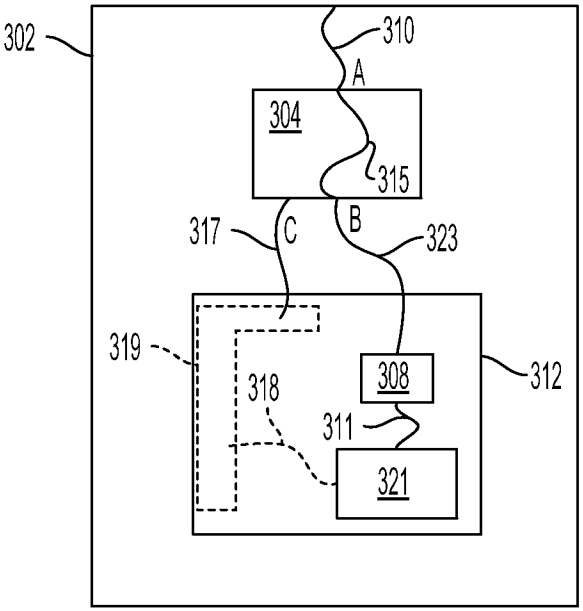

FIGS. 3A and 3B are diagrams illustrating embodiments of the antenna apparatus for a wireless device of FIG. 2A. Elements in FIGS. 3A and 3B that are similar to elements in FIG. 2A are labeled using the nomenclature 3XX, where "3XX" in FIG. 3A and 3B denotes a similar element "2XX" in FIG. 2A.

In FIG. 3A, the antenna matching circuit 308 is located on the circuit card assembly 312. In this embodiment, the interconnection element 304 can comprise a three port device or structure with the ports labeled "A," "B" and "C." A feed connection 315 is illustrated as being internal to the interconnection element 304, while a ground connection 317 and a connection 323 to the circuit card assembly 312 are shown as being external to the interconnection element 304. However, the connections 315, 317 and 323 all comprise connections that can be internal or external to the interconnection element 304. In the embodiment shown in FIG. 3A, a single connection 310 electrically connects the metallic bezel 302 to the circuit card assembly 312 via the interconnection element 304. The circuit card assembly 312 also comprises an RF circuit 321 and a ground plane 319 connected by a conductor 318.

In the embodiment shown in FIG. 3A, the interconnection element 304 has three points of contact, the first point of contact being the single connection 310 between the metallic bezel 302 and the interconnection element 304, the second point of contact being the connection 323 between the antenna matching circuit 308 on the circuit card assembly 312 and the interconnection element 304, and the third point of contact being the ground connection 317 between the interconnection element 304 and the ground plane 319. A connection 311 connects the antenna matching circuit 308 to the RF circuit 321.

In FIG. 3B, the antenna matching circuit 308 is located on the interconnection element 304. In this embodiment, the interconnection element 304 can comprise a three port device with the ports labeled "A," "B" and "C." A feed connection 315 is illustrated as being internal to the interconnection element 304, while a ground connection 317 and a connection 323 to the circuit card assembly 312 are shown as being external to the interconnection element 304. However, the connections 315, 317 and 323 all comprise connections that can be internal or external to the interconnection element 304. In the embodiment shown in FIG. 3B, a single connection 310 electrically connects the metallic bezel 302 to the circuit card assembly 312 via the interconnection element 304. The circuit card assembly 312 also comprises an RF circuit 321 and a ground plane 319 connected by a conductor 318.

In the embodiment shown in FIG. 3B, the interconnection element 304 has three points of contact, the first point of contact being the single connection 310 between the metallic bezel 302 and the interconnection element 304, the second point of contact being the connection 323 between the antenna matching circuit 308 on the interconnection element 304 and the RF circuit 321, and the third point of contact being the ground connection 317 between the interconnection element 304 and the ground plane 319.

Although shown as separate connections for ease of illustration, the connections 310, 315, 317 and 323 can be incorporated into, and/or can be formed as part of, the interconnection element 304. The connection 318 is shown as a dotted line to signify that it may be located on any of a number of different layers of the circuit card assembly 312.

Figure 4B:
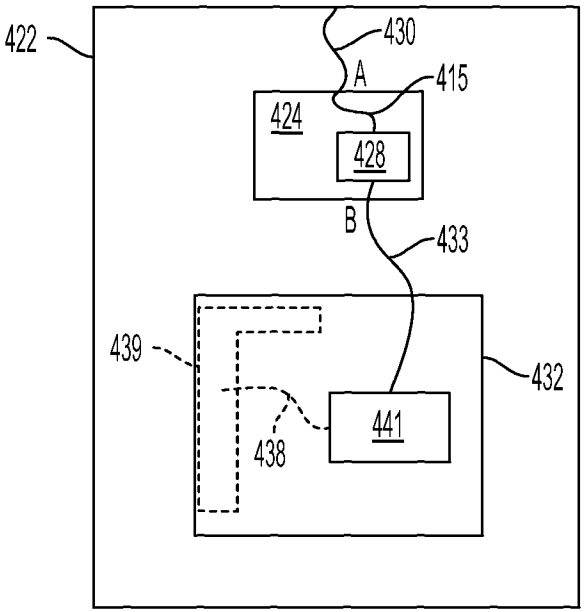
FIGS. 4A and 4B are diagrams illustrating embodiments of the antenna apparatus for a wireless device of FIG. 2B.
Figure 4A:
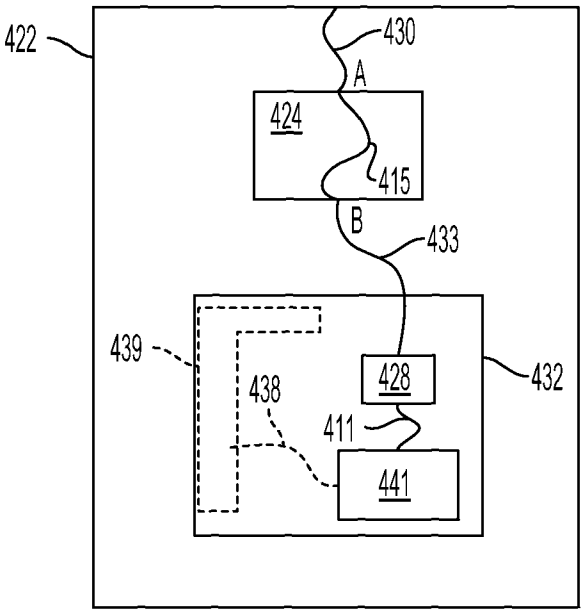

FIGS. 4A and 4B are diagrams illustrating embodiments of the antenna apparatus for a wireless device of FIG. 2B. Elements in FIGS. 4A and 4B that are similar to elements in FIG. 2B are labeled using the nomenclature 4XX, where "4XX" in FIGS. 4A and 4B denotes a similar element "2XX" in FIG. 2B.

In FIG. 4A, the antenna matching circuit 428 is located on the circuit card assembly 432. In this embodiment, the interconnection element 424 can comprise a two port device with the ports labeled "A" and "B." A feed connection 415 is illustrated as being internal to the interconnection element 424, while a connection 433 to the circuit card assembly 432 is shown as being external to the interconnection element 424. However, the connections 415 and 433 all comprise connections that can be internal or external to the interconnection element 424. In the embodiment shown in FIG. 4A, a single connection 430 electrically connects the metallic bezel 422 to the circuit card assembly 432 via the interconnection element 424. The circuit card assembly 432 also comprises an RF circuit 441 and a ground plane 439 connected by a conductor 438.

In the embodiment shown in FIG. 4A, the interconnection element 424 has two points of contact, the first point of contact being the single connection 430 between the metallic bezel 422 and the interconnection element 424, and the second point of contact being the connection 433 between the antenna matching circuit 428 on the circuit card assembly 432 and the interconnection element 424. A connection 411 connects the antenna matching circuit 428 to the RF circuit 441.

In FIG. 4B, the antenna matching circuit 428 is located on the interconnection element 424. In this embodiment, the interconnection element 424 can comprise a two port device with the ports labeled "A" and "B." A feed connection 415 is illustrated as being internal to the interconnection element 424, while a connection 433 to the circuit card assembly 432 is shown as being external to the interconnection element 424. However, the connections 415 and 433 all comprise connections that can be internal or external to the interconnection element 424. In the embodiment shown in FIG. 4B, a single connection 430 electrically connects the metallic bezel 422 to the circuit card assembly 432 via the interconnection element 424. The circuit card assembly 432 also comprises an RF circuit 441 and a ground plane 439 connected by a conductor 438.

In the embodiment shown in FIG. 4B, the interconnection element 424 has two points of contact, the first point of contact being the single connection 430 between the metallic bezel 422 and the interconnection element 424, and the second point of contact being the connection 433 between the antenna matching circuit 428 on the interconnection element 424 and the RF circuit 441.

Although shown as separate connections for ease of illustration, the connections 430, 415 and 433 can be incorporated into, and/or can be formed as part of, the interconnection element 424. The connection 438 is shown as a dotted line to signify that it may be located on any of a number of different layers of the circuit card assembly 312.

Figure 5:
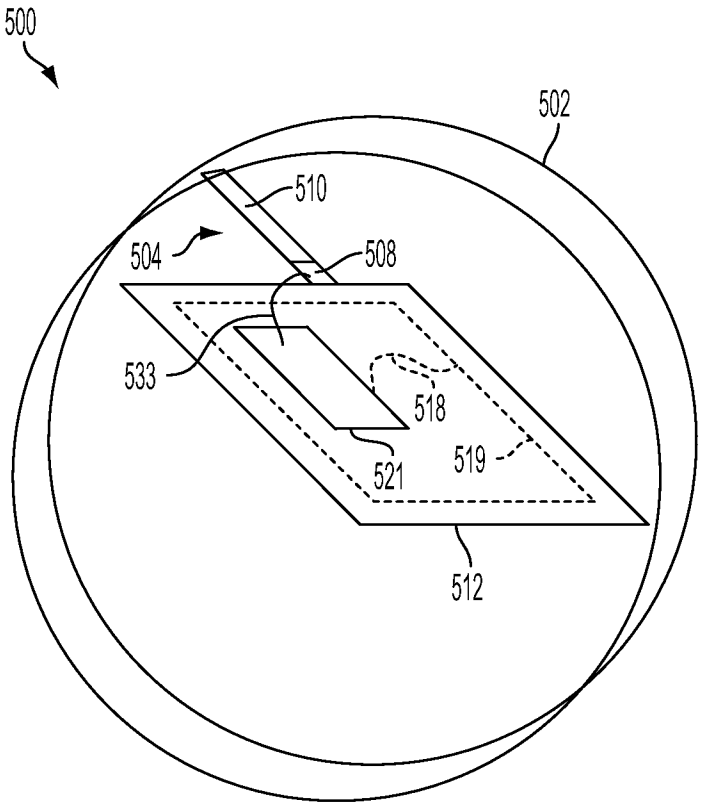
FIG. 5 is a diagram illustrating another embodiment of an antenna apparatus for a wireless device.

FIG. 5 is a diagram illustrating another embodiment of an antenna apparatus for a wireless device. Elements in FIG. 5 that are similar to elements in FIG. 1 are labeled using the nomenclature 5XX, where "5XX" in FIG. 5 denotes a similar element "1XX" in FIG. 1. In FIG. 5, the antenna apparatus 500 uses a metallic band 502, such as a wristband of a wristwatch or another wrist-worn device as a transducer. In this embodiment, the metallic band 502 comprises an embodiment of the continuous metallic component 102 described above, and is located in a plane that is substantially perpendicular to a plane in which a circuit card assembly 512 is located. The interconnection element 504 and antenna matching circuit 508 are shown for reference. The circuit card assembly 512 also comprises an RF circuit 521 and a ground plane 519 connected by a conductor 518. In the embodiment shown in FIG. 5, a single connection 510 electrically connects the metallic band 502 to the circuit card assembly 512 via the interconnection element 504 and the antenna matching circuit 508.

In the embodiment shown in FIG. 5, the interconnection element 504 has only two points of contact, the first point of contact being the single connection 510 to the metallic band 502, and the second point of contact being the connection 533 to connect the RF circuit 521 on the circuit card assembly 512 to the interconnection element 504 via the antenna matching circuit 508.

Figure 6B:
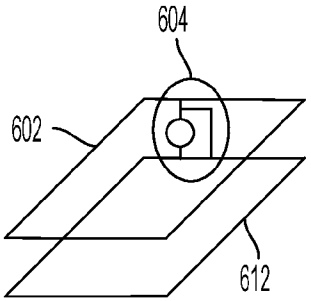
FIGS. 6A through 6D are diagrams illustrating alternative embodiments of the antenna apparatus for a wireless device.
Figure 6D:
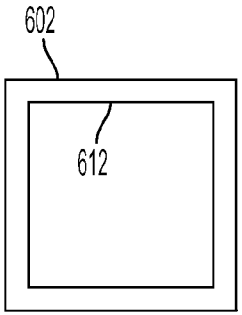
Figure 6A:
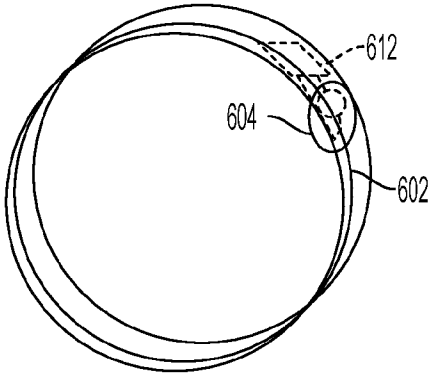

FIGS. 6A through 6D are diagrams illustrating alternative embodiments of the antenna apparatus for a wireless device. Elements in FIGS. 6A through 6D that are similar to elements in FIG. 1 are labeled using the nomenclature 6XX, where "6XX" in FIGS. 6A through 6D denotes a similar element "1XX" in FIG. 1. FIG. 6A is a perspective view illustrating an embodiment in which the circuit card assembly 612 can be located inside of a wristband or bracelet. The interconnection element 604 and the continuous metallic component 602 are shown for reference.

FIG. 6B is a perspective view illustrating the circuit card assembly 612, interconnection element 604 and the continuous metallic component 602. In FIG. 6B, the continuous metallic component 602 is located in a plane that is above the plane in which the circuit card assembly 612 is located.

Figure 6C:
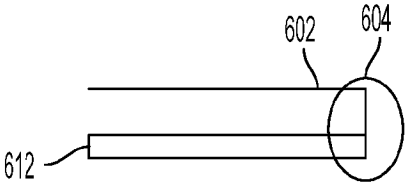

FIG. 6C is a side view illustrating the circuit card assembly 612, the interconnection element 604 and the continuous metallic component 602 of FIG. 6B.

FIG. 6D is a top plan view illustrating the circuit card assembly 612 and the continuous metallic component 602. It should be noted that in all of the embodiments described herein, the circuit card assembly can be smaller, larger, or similar in size to the continuous metallic component. The interconnection element and the antenna matching circuit are not shown in FIG. 6D for simplicity.

Figure 7:
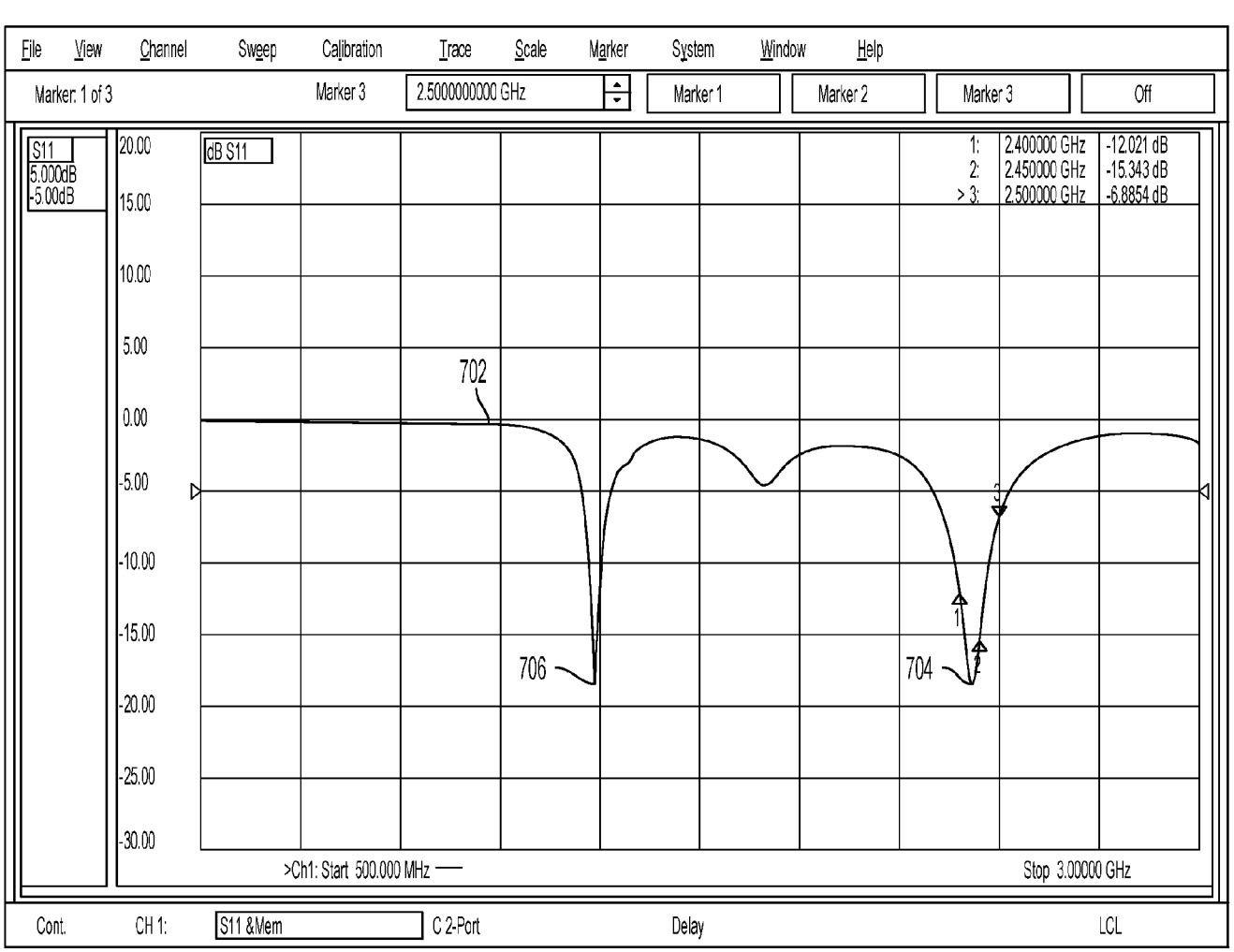
FIG. 7 is a graphical diagram illustrating example return loss of an embodiment of an antenna apparatus for a wireless device.

FIG. 7 is a graphical diagram 700 illustrating example return loss of an embodiment of an antenna apparatus for a wireless device. The trace 702 illustrates a return loss of approximately −18 dB at a frequency of approximately 2.44 GHz, illustrated at point 704. In addition to the frequency of approximately 2.44 GHz, the trace 702 illustrates a return loss of approximately −18 dB at a frequency of approximately 1.5 GHz, illustrated at point 706. This illustrates a dual-resonant band application where the embodiments of the antenna matching circuit and the interconnection element described herein can be designed to allow the continuous metallic component to be resonant at multiple frequencies, and therefore function as a transducer at more than one desired frequency. The frequencies of 2.44 GHz and 1.5 GHz are for example purposes only. The frequencies are not limited to two, and are dependent upon a number of factors including, but not limited to, the design of the antenna matching circuit and the design of the interconnection element.

FIG. 8 is a graphical diagram illustrating dual polarization performance of an embodiment of an antenna apparatus for a wireless device. The dual polarization performance is enhanced by current flowing in two directions in the embodiments of the continuous metallic component 102 described herein.

Figure 9:
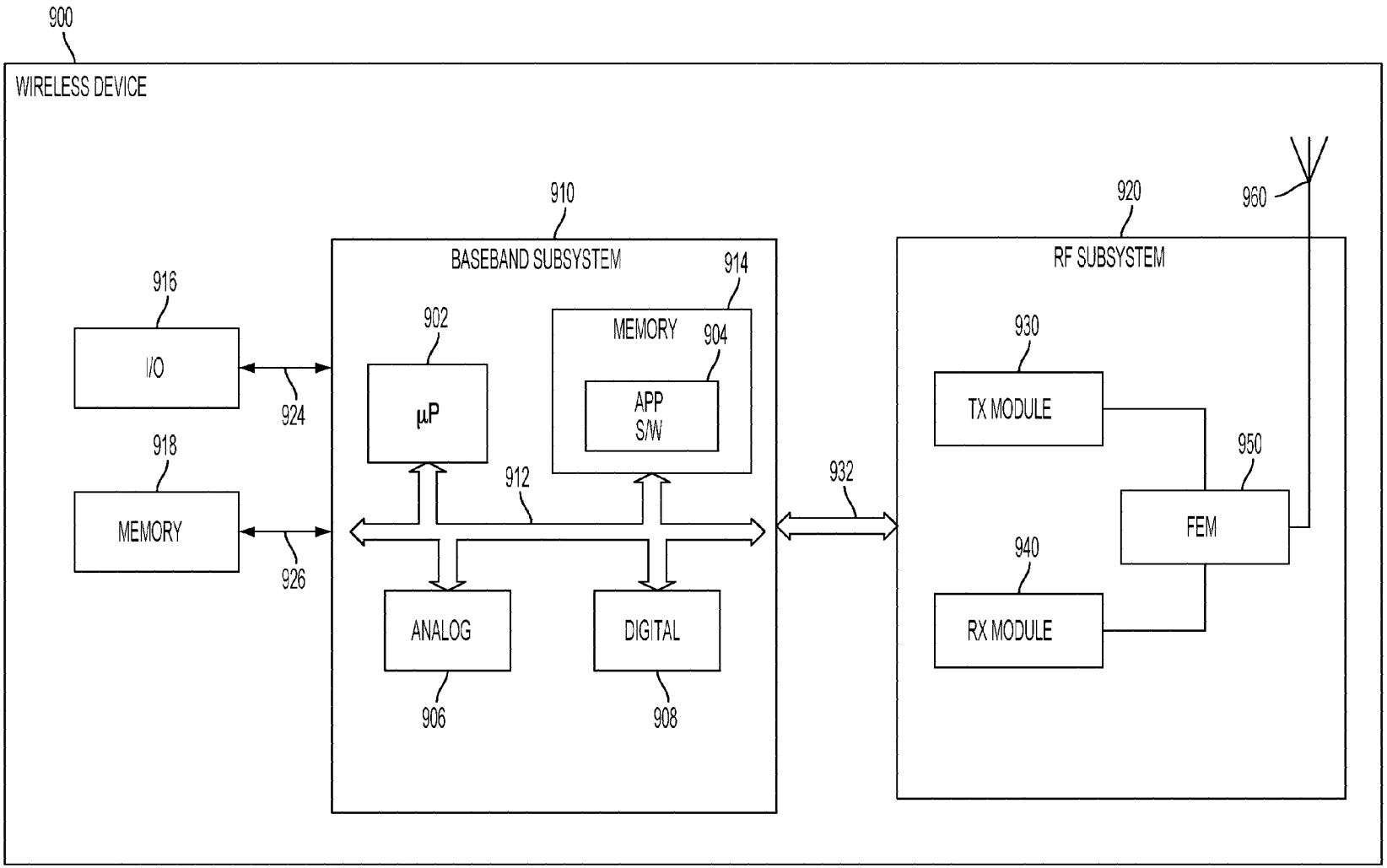
FIG. 9 is a block diagram illustrating an example of a wireless device in which the antenna apparatus for a wireless device can be implemented.

FIG. 9 is a block diagram illustrating an example of a wireless device 900 in which the antenna apparatus for a wireless device can be implemented. In an embodiment, the wireless device 900 can be a "Bluetooth" wireless communication device, a portable cellular telephone, a WiFi enabled communication device, or can be any other communication device. Embodiments of the antenna apparatus for a wireless device can be implemented in any communication device. The wireless device 900 illustrated in FIG. 9 is intended to be a simplified example of a cellular telephone and to illustrate one of many possible applications in which the antenna apparatus for a wireless device can be implemented. One having ordinary skill in the art will understand the operation of a portable cellular telephone, and, as such, implementation details are omitted. In an embodiment, the wireless device 900 includes a baseband subsystem 910 and an RF subsystem 920 connected together over a system bus 932. The system bus 932 can comprise physical and logical connections that couple the above-described elements together and enable their interoperability. In an embodiment, the RF subsystem 920 can be a wireless transceiver. Although details are not shown for clarity, the RF subsystem 920 generally includes a transmit module 930 having modulation, upconversion and amplification circuitry for preparing and transmitting a baseband information signal, includes a receive module 940 having amplification, filtering and downconversion circuitry for receiving and downconverting an RF signal to a baseband information signal to recover data, and includes a front end module (FEM) 950 that includes diplexer circuitry, duplexer circuitry, or any other circuitry that can separate a transmit signal from a receive signal, as known to those skilled in the art. An antenna 960 is connected to the FEM 950. The antenna 960 can comprise any of the embodiments of an antenna apparatus for a wireless device as described herein. When implemented as shown in FIG. 9, the antenna apparatus for a wireless device can be implemented as part of one or more modules that comprise the RF subsystem 920.

The baseband subsystem 910 generally includes a processor 902, which can be a general purpose or special purpose microprocessor, memory 914, application software 904, analog circuit elements 906, and digital circuit elements 908, coupled over a system bus 912. The system bus 912 can comprise the physical and logical connections to couple the above-described elements together and enable their interoperability.

An input/output (I/O) element 916 is connected to the baseband subsystem 910 over connection 924 and a memory element 918 is coupled to the baseband subsystem 910 over connection 926. The I/O element 916 can include, for example, a microphone, a keypad, a speaker, a pointing device, user interface control elements, and any other devices or system that allow a user to provide input commands and receive outputs from the wireless device 900.

The memory 918 can be any type of volatile or non-volatile memory, and in an embodiment, can include flash memory. The memory 918 can be permanently installed in the wireless device 900, or can be a removable memory element, such as a removable memory card.

The processor 902 can be any processor that executes the application software 904 to control the operation and functionality of the wireless device 900. The memory 914 can be volatile or non-volatile memory, and in an embodiment, can be non-volatile memory that stores the application software 904.

The analog circuitry 906 and the digital circuitry 908 include the signal processing, signal conversion, and logic that convert an input signal provided by the I/O element 916 to an information signal that is to be transmitted. Similarly, the analog circuitry 906 and the digital circuitry 908 include the signal processing elements used to generate an information signal that contains recovered information from a received signal. The digital circuitry 908 can include, for example, a digital signal processor (DSP), a field programmable gate array (FPGA), or any other processing device. Because the baseband subsystem 910 includes both analog and digital elements, it can be referred to as a mixed signal device (MSD).

Figure 10A:
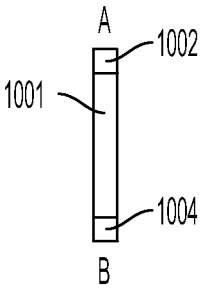
FIGS. 10A through 10K show example embodiments of the interconnection element of an antenna apparatus for a wireless device.

FIGS. 10A through 10K show example embodiments of the interconnection element of an antenna apparatus for a wireless device. Other designs and embodiments of the interconnection element are possible. FIG. 10A shows a two port interconnection element 1001 with a first port "A" having a contact 1002 and a second port B having a contact 1004.

Figure 10B:
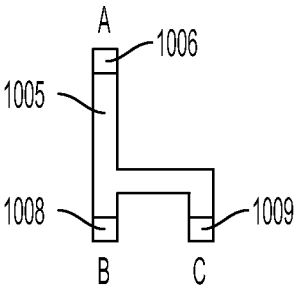

FIG. 10B shows a three port interconnection element 1005 with a first port "A" having a contact 1006, a second port B having a contact 1008 and a third port "C" having a contact 1009.

Figure 10C:
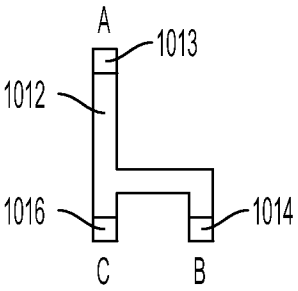

FIG. 10C shows a three port interconnection element 1012 with a first port "A" having a contact 1013, a second port B having a contact 1014 and a third port "C" having a contact 1016.

Figure 10D:
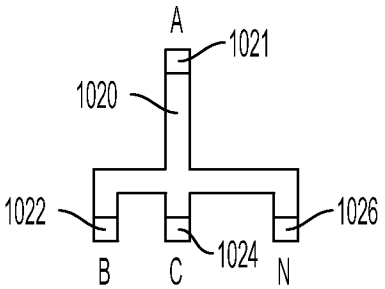

FIG. 10D shows a four port interconnection element 1020 with a first port "A" having a contact 1021, a second port B having a contact 1022, a third port "C" having a contact 1024 and a fourth port "N" having a contact 1026. The contact 1026 is denoted as contact "N" to illustrate that the interconnection element 1020 can have any number of contacts.

Figure 10E:
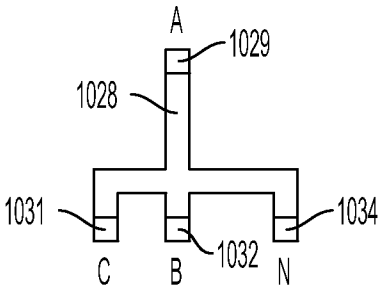

FIG. 10E shows a four port interconnection element 1028 with a first port "A" having a contact 1029, a second port B having a contact 1032, a third port "C" having a contact 1031 and a fourth port "N" having a contact 1034. The contact 1034 is denoted as contact "N" to illustrate that the interconnection element 1028 can have any number of contacts.

Figure 10G:
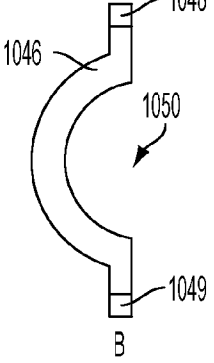
Figure 10F:
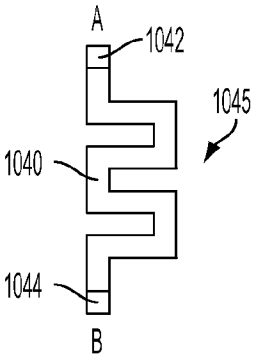

FIG. 10F shows a two port interconnection element 1040 with a first port "A" having a contact 1042 and a second port B having a contact 1044. The body portion 1045 comprises a meandering shaped structure.

FIG. 10G shows a two port interconnection element 1046 with a first port "A" having a contact 1048 and a second port B having a contact 1049. The body portion 1050 comprises a curved shaped structure.

Figure 10H:
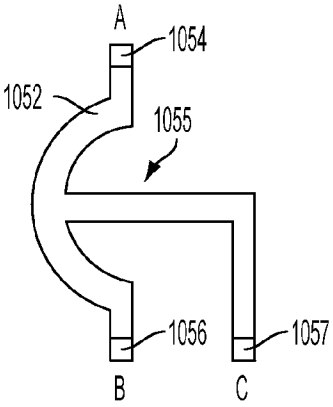

FIG. 10H shows a three port interconnection element 1052 with a first port "A" having a contact 1054, a second port B having a contact 1056 and a third port "C" having a contact 1057. The body portion 1055 comprises a combination of a curved shaped structure and an "L" shaped structure.

Figure 10J:
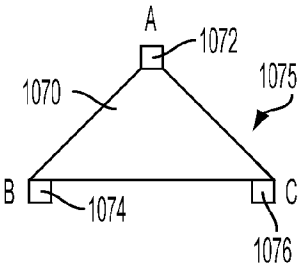
Figure 10I:
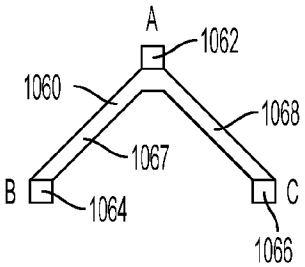

FIG. 10I shows a three port interconnection element 1060 with a first port "A" having a contact 1062, a second port B having a contact 1064 and a third port "C" having a contact 1066. The body portion comprises a triangular shaped structure having legs 1067 and 1068.

FIG. 10J shows a three port interconnection element 1070 with a first port "A" having a contact 1072, a second port B having a contact 1074 and a third port "C" having a contact 1076. The body portion 1075 comprises a triangular shaped structure.

Figure 10K:
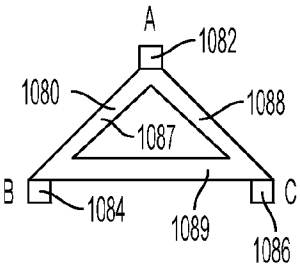

FIG. 10K shows a three port interconnection element 1080 with a first port "A" having a contact 1082, a second port B having a contact 1084 and a third port "C" having a contact 1086. The body portion comprises a triangular shaped structure having legs 1087, 1088 and 1089.

The interconnection elements of FIGS. 10A, 10F and 10G can be any of the embodiments of the interconnection element described herein having two points of contact between the embodiments of the continuous metallic component and the circuit card assembly, or any other embodiments thereof.

The interconnection elements of FIGS. 10B, 10C, 10D, 10E, 10H, 10I, 10J and 10K can be any of the embodiments of the interconnection element described herein having three or more points of contact between the embodiments of the continuous metallic component and the circuit card assembly, or any other embodiments thereof.

The embodiments of the interconnect element described herein can comprise two, three, four, or more ports. Indeed, the interconnection element can be designed to have any number of ports. Further, the design of the interconnection element and the connections thereto influence the frequency or frequencies at which the continuous metallic component 102, or any embodiment thereof, described herein, will resonate and operate as a transducer at one or more desired resonant frequencies.

In view of the disclosure above, one of ordinary skill in programming is able to write computer code or identify appropriate hardware and/or circuits to implement the disclosed invention without difficulty based on the flow charts and associated description in this specification, for example. Therefore, disclosure of a particular set of program code instructions or detailed hardware devices is not considered necessary for an adequate understanding of how to make and use the invention. The inventive functionality of the claimed computer implemented processes is explained in more detail in the above description and in conjunction with the figures which may illustrate various process flows.

In one or more exemplary aspects, the functions described may be implemented in hardware, software, firmware, or any combination thereof. If implemented in software, the functions may be stored on or transmitted as one or more instructions or code on a computer-readable medium. Computer-readable media include both computer storage media and communication media including any medium that facilitates transfer of a computer program from one place to another. A storage media may be any available media that may be accessed by a computer. By way of example, and not limitation, such computer-readable media may comprise RAM, ROM, EEPROM, CD-ROM or other optical disk storage, magnetic disk storage or other magnetic storage devices, or any other medium that may be used to carry or store desired program code in the form of instructions or data structures and that may be accessed by a computer.

Also, any connection is properly termed a computer-readable medium. For example, if the software is transmitted from a website, server, or other remote source using a coaxial cable, fiber optic cable, twisted pair, digital subscriber line ("DSL"), or wireless technologies such as infrared, radio, and microwave, then the coaxial cable, fiber optic cable, twisted pair, DSL, or wireless technologies such as infrared, radio, and microwave are included in the definition of medium.

Disk and disc, as used herein, includes compact disc ("CD"), laser disc, optical disc, digital versatile disc ("DVD"), floppy disk and Blu-Ray disc where disks usually reproduce data magnetically, while discs reproduce data optically with lasers. Combinations of the above should also be included within the scope of computer-readable media.

Although selected aspects have been illustrated and described in detail, it will be understood that various substitutions and alterations may be made therein without departing from the spirit and scope of the present invention, as defined by the following claims.

What is claimed is:

1. An antenna apparatus for a wireless device, comprising:

a continuous metallic component electrically connected to a circuit card assembly through an interconnection;

an antenna matching circuit electrically connected to the continuous metallic component;

a first electrical connection between the continuous metallic component and the interconnection; and at least one additional electrical connection between the interconnection and the circuit card assembly, the antenna matching circuit and the interconnection causing the continuous metallic component to resonate at an at least one desired frequency.

2. The apparatus of claim 1, wherein the antenna matching circuit is located on the circuit card assembly and the at least one additional electrical connection is located between the interconnection and the antenna matching circuit.

3. The apparatus of claim 1, wherein the antenna matching circuit is located on the interconnection and the at least one additional electrical connection is located between the antenna matching circuit and the circuit card assembly.

4. The apparatus of claim 1, wherein the antenna matching circuit is located on the circuit card assembly and the at least one additional electrical connection is located between the interconnection and the antenna matching circuit, the apparatus further comprising at least a second additional electrical connection between the interconnection and a ground plane on the circuit card assembly.

5. The apparatus of claim 1, wherein the antenna matching circuit is located on the interconnection and the at least one additional electrical connection is located between the antenna matching circuit and the circuit card assembly, the apparatus further comprising at least a second additional electrical connection between the interconnection and a ground plane on the circuit card assembly.

6. The apparatus of claim 1, wherein the continuous metallic component comprises any of a bezel, a bracelet, a cuff, and a band associated with the wireless device.

7. The apparatus of claim 1, wherein the antenna matching circuit and interconnection electrically matches an impedance of the continuous metallic component so that the antenna apparatus resonates at the at least one desired frequency.

8. The apparatus of claim 1, wherein the wireless device is a wrist-worn device.

9. The apparatus of claim 1, wherein the wireless device is a tablet computing device.

10. The apparatus of claim 1, wherein the continuous metallic component is a random length that is independent of a length corresponding to a wavelength of a communication signal at the at least one desired frequency.

11. The apparatus of claim 1, wherein the continuous metallic component operates as a transmit antenna and as a receive antenna.

12. The apparatus of claim 1, wherein the antenna matching circuit and the interconnection cause the continuous metallic component to resonate at a second desired frequency in addition to the at least one desired frequency.

13. A wireless device, comprising:

a radio frequency (RF) subsystem configured to allow bidirectional wireless communication, the RF subsystem having an antenna apparatus;

a continuous metallic component electrically connected to a circuit card assembly through an interconnection;

an antenna matching circuit electrically connected to the continuous metallic component;

a first electrical connection between the continuous metallic component and the interconnection; and at least one additional electrical connection between the interconnection and the circuit card assembly, the antenna matching circuit and the interconnection causing the continuous metallic component to resonate at an at least one desired frequency.

14. The wireless device of claim 13, wherein the antenna matching circuit is located on the circuit card assembly and the at least one additional electrical connection is located between the interconnection and the antenna matching circuit.

15. The wireless device of claim 13, wherein the antenna matching circuit is located on the interconnection and the at least one additional electrical connection is located between the antenna matching circuit and the circuit card assembly.

16. The wireless device of claim 13, wherein the antenna matching circuit is located on the circuit card assembly and the at least one additional electrical connection is located between the interconnection and the antenna matching circuit, the apparatus further comprising at least a second additional electrical connection between the interconnection and a ground plane on the circuit card assembly.

17. The wireless device of claim 13, wherein the antenna matching circuit is located on the interconnection and the at least one additional electrical connection is located between the antenna matching circuit and the circuit card assembly, the apparatus further comprising at least a second additional electrical connection between the interconnection and a ground plane on the circuit card assembly.

18. The wireless device of claim 13, wherein the continuous metallic component comprises any of a bezel, a bracelet, a cuff, and a band associated with the wireless device.

19. The wireless device of claim 13, wherein the antenna matching circuit and interconnection electrically matches an impedance of the continuous metallic component so that the antenna apparatus resonates at the at least one desired frequency.

20. The wireless device of claim 13, wherein the wireless device is a wrist-worn device.

21. The wireless device of claim 13, wherein the wireless device is a tablet computing device.

22. The wireless device of claim 13, wherein the continuous metallic component is a random length that is independent of a length corresponding to a wavelength of a communication signal at the at least one desired frequency.

23. The wireless device of claim 13, wherein the continuous metallic component operates as a transmit antenna and as a receive antenna.

24. The wireless device of claim 13, wherein the antenna matching circuit and the interconnection are configured to cause the continuous metallic component to resonate at a second desired frequency in addition to the at least one desired frequency.

25. A method for using an antenna apparatus for a wireless device, comprising:

electrically connecting a continuous metallic component to a circuit card assembly through an interconnection;

electrically connecting an antenna matching circuit to the continuous metallic component;

electrically connecting the continuous metallic component and the interconnection using a first electrical connection; and electrically connecting the interconnection and the circuit card assembly using at least one additional electrical connection, the antenna matching circuit and the interconnection configured to cause the continuous metallic component to resonate at an at least one desired frequency.

26. The method of claim 25, further comprising:

locating the antenna matching circuit on the circuit card assembly; and electrically connecting the at least one additional electrical connection between the interconnection and the antenna matching circuit.

27. The method of claim 25, further comprising:

locating the antenna matching circuit on the interconnection; and electrically connecting the at least one additional electrical connection between the antenna matching circuit and the circuit card assembly.

28. The method of claim 25, further comprising:

locating the antenna matching circuit on the circuit card assembly;

locating the at least one additional electrical connection between the interconnection and the antenna matching circuit; and electrically connecting at least a second additional electrical connection between the interconnection and a ground plane on the circuit card assembly.

29. The method of claim 25, further comprising:

locating the antenna matching circuit on the interconnection;

locating the at least one additional electrical connection between the antenna matching circuit and the circuit card assembly; and electrically connecting at least a second additional electrical connection between the interconnection and a ground plane on the circuit card assembly.

30. The method of claim 25, wherein the continuous metallic component comprises any of a bezel, a bracelet, a cuff, and a band associated with the wireless device.

31. The method of claim 25, further comprising electrically matching an impedance of the continuous metallic component so that the antenna apparatus resonates at the at least one desired frequency.

32. The method of claim 25, wherein the wireless device is a wrist-worn device.

33. The method of claim 25, wherein the wireless device is a tablet computing device.

34. The method of claim 25, wherein the continuous metallic component is a random length that is independent of a length corresponding to a wavelength of a communication signal at the at least one desired frequency.

35. The method of claim 25, further comprising operating the continuous metallic loop shaped component as a transmit antenna and as a receive antenna.

36. The method of claim 25, further comprising configuring the antenna matching circuit and interconnection so that the continuous metallic component resonates at a second desired frequency in addition to the at least one desired frequency.

* * * * *